US005355604A

United States Patent [19]

Rathke

[11] Patent Number: 5,355,604

[45] Date of Patent: Oct. 18, 1994

[54] SIGN UTILIZING AMBIENT ILLUMINATION

[75] Inventor: Roy M. Rathke, New Berlin, Wis.

[73] Assignee: Everbrite, Inc., Greenfield, Wis.

[21] Appl. No.: 140,773

[22] Filed: Oct. 21, 1993

[51] Int. Cl.[5] ..... G09F 7/20

[52] U.S. Cl. ..... 40/601; 40/617; 362/375; 362/408; 248/323; 160/24

[58] Field of Search ..... 40/584, 601, 617, 624; 362/147, 375, 396, 408; 160/23.1, 24, 29; 248/342-344, 323

[56] References Cited

U.S. PATENT DOCUMENTS

| | | | |
|---|---|---|---|
| 4,041,657 | 8/1977 | Schuplin | 248/343 |
| 4,159,162 | 6/1979 | Christoffel | 160/24 |
| 4,290,218 | 9/1981 | Drueck, Jr. | 362/396 |
| 4,434,570 | 3/1984 | Roos | 40/617 |
| 5,274,938 | 1/1994 | McDonald et al. | 40/617 |
| 5,282,331 | 2/1994 | Fell | 40/617 |

OTHER PUBLICATIONS

New Berlin, Wis., U.S.A.-"Light Thief Assembly Instructions", Process Displays, Inc., precedes Oct. 21, 1993.

*Primary Examiner*—Edward K. Look
*Assistant Examiner*—Christopher Verdier
*Attorney, Agent, or Firm*—Ryan, Kees & Hohenfeldt

[57] ABSTRACT

A sign body has light transmitting side panels for displaying information. The panels are arranged adjacent each other in a relationship that provides a top opening for entry between the panels of light emitted from fluorescent tubes in a light fixture mounted in the ceiling of a room. A reel having a spindle on which a web similar to a household window shade is wound. The sign body is supported on the free end of the web. The sign body can be raised manually sufficiently for the top opening to be near the light source for illuminating the panels from inside of the body and the body can be held there by tension in the web. The body can be pulled down manually in which case the web unwinds and holds the sign body at a level above the floor of the room so the sign can be accessed for maintenance or exchange of information bearing media.

6 Claims, 3 Drawing Sheets

SIGN UTILIZING AMBIENT ILLUMINATION

BACKGROUND OF THE INVENTION

The invention disclosed herein pertains to a sign that is suspended in proximity to an overhead ceiling light fixture for obtaining illumination from the fluorescent tubes or other lamps in the fixture which is intended for lighting a room such as a retail store.

The sign disclosed herein is an improvement over a type of sign known to those involved in sign technology as a Light Thief. Such signs are used indoors at the point of sale to attract attention to a product by displaying information and images such as the name of the product, its picture or other characteristics. The images and other information are on transparency sheets or films that can be exchanged. The sign is a parasite because it is illuminated from a ceiling fixture which is intended to light the room but the sign has no light source of its own.

Existing signs of the type hereunder consideration are characterized as a light transmitting plastic sheet bent along a lengthwise line to create two side panels having a cross-section corresponding to the letter V. Translucent V-shaped end panels close the ends of the unitary side panels and are secured to the side panels with push nails or screws to produce a rigid V-shaped sign structure. The flexible information bearing transparencies or films are placed on the inside surfaces of the side or end panels or both to modulate light from the fixture and thereby yield an image that can be visualized on the outside of the panels. Existing signs of this general type have a small torsion spring-biased cable or cord reel mounted to the inside face of each end panel. The free ends of the cords or cables that extend from the respective reels are provided with suitable hardware for hooking onto the ceiling runners or grid members, for example, that have the shape of an inverted T for supporting acoustic ceiling panels. The runners or grid members also provide a frame around the fluorescent tube fixtures. The installer of the sign usually stands on a step ladder with the sign in his or her hands to negotiate hooking the cables onto the ceiling runners for the inside of the sign to be backlighted by light emitted from the fluorescent tubes. Thus, the indicia on the transparencies can be visualized from floor level.

One of the problems with prior ambient light employing signs becomes evident when a sign is to be drawn down on the spring tensioned cords for cleaning the sign and/or exchanging transparencies while the maintenance person is standing on the floor. The problem is that the sign tends to come down out of level. Manipulating it to a level state sometimes results in the spring biased reels becoming unlatched so there is a tendency for the sign to ascend inadvertently under the force of the springs in the reels. The person who wants to exchange the indicia bearing transparencies or clean the sign must hold the sign body so it does not go up and at the same time the person must try to get the transparencies secured and squared up against the inside surfaces of the side or end panels of the sign body. Manufacturers of the existing parasitic light employing signs admonish users to not release the sign while pulling it down or it will spring up and collide with the grid that frames the fluorescent tube fixture. Even worse is the case of the sign body being canted due to one of the cables being more retracted in the reel than the other when an inadvertent upward recoil happens. In such case, one end of the sign will impact the light fixture with all the force concentrated along one point or line.

An objective of the present invention is to provide an ambient light employing sign with means that assure the sign will descend in a level state and stay in a level state free of any manual assistance when it is lowered to the desired level for servicing such as for cleaning the sign or exchanging the transparent films on which are the indicia that are to be displayed.

SUMMARY OF THE INVENTION

The parasitic light utilizing sign illustrated and described herein overcomes the disadvantages of prior signs mentioned above. According to the invention, the sign is supported in a unique way using the principles of a conventional window shade. Thus, the support device comprises a tubular spindle having cylindrical caps as opposite ends, a cylindrical pin extending axially from one end of the spindle and a non-cylindrical locking pin extending from the other end. The locking pin is connected to a spring that is internal to the spindle and is coaxial with the bore of the spindle. A conventional ratchet and pawl are the tubular spindle. A web wraps on the spindle and has one end fastened to the spindle in the manner of a conventional window shade. The free end of the web has a rod fastened to it. The rod is longer than the web is wide, so the bare ends of the rod extend laterally away from opposite side edges of the web for engaging opposite ends of the rod mounted to the inside face of each of the end panels of the sign so the sign can be supported from the web. The spindle is suitably mounted immediately beneath the fluorescent light fixture. The sign can be raised or lowered by pushing it up or pulling it down as would be the case with manipulating a window shade. The sign body moves up and down in a level fashion because it is engaged by the laterally extending rod ends nested in notches in the spaced apart end panels so there is no opportunity for one end of the sign body to get ahead of the other because the web compels the rod to stay level.

How the objectives and features of the improved sign are implemented will be evident in the ensuing more detailed description of a preferred embodiment of the invention which will now be set forth in reference to the drawings.

DETAILED DESCRIPTION OF THE DRAWINGS

DESCRIPTION OF A PREFERRED EMBODIMENT

Figure 2:
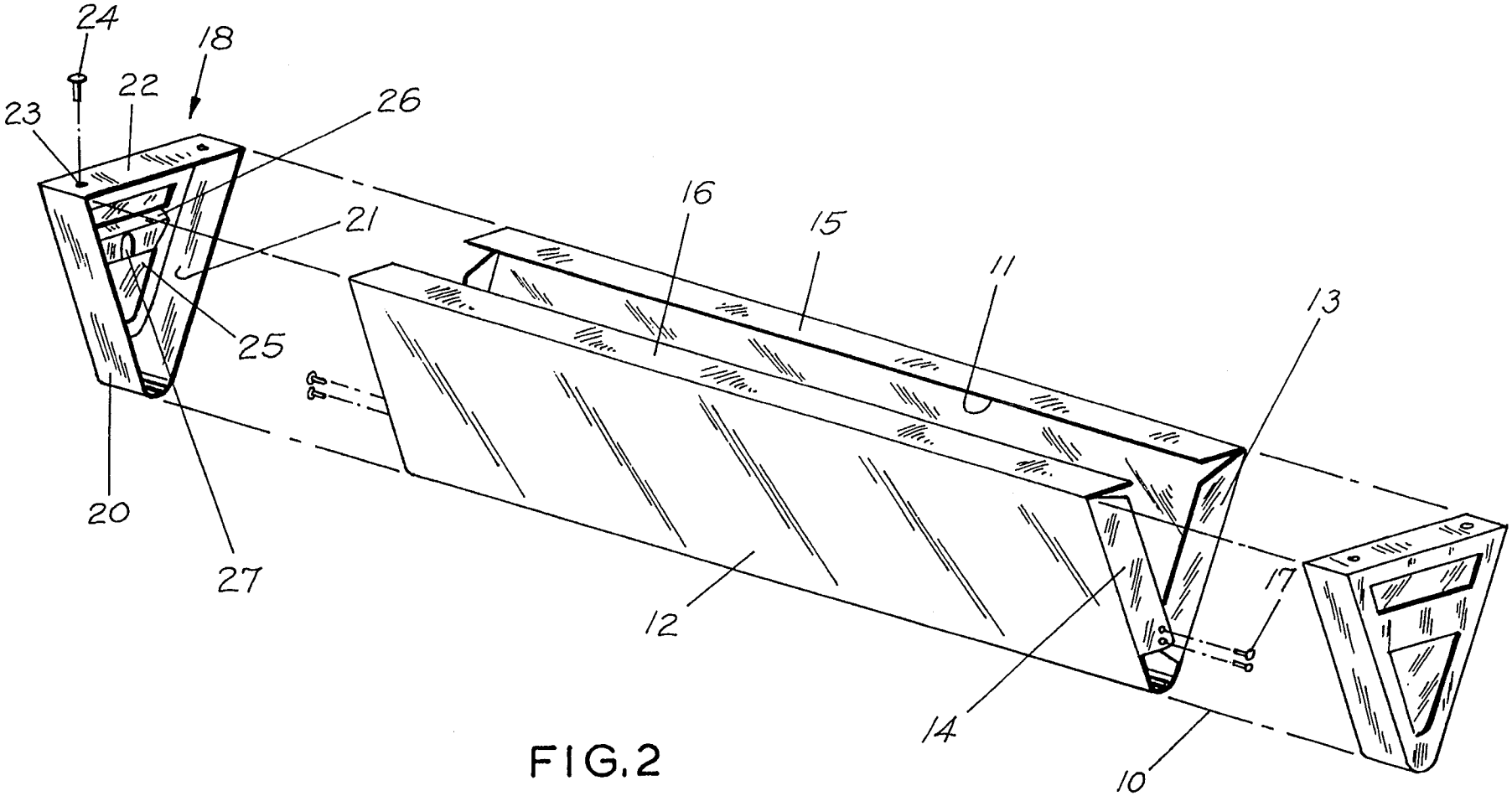
FIG. 2 is an exploded perspective view of the sign body by itself for illustrating how the end members or panels mate with the ends of the V-shaped sign body.

The body of the sign will be described first in reference to FIG. 2. This FIGURE shows a sheet of light transmitting plastic which is bent along a lengthwise extending centerline so the sheet becomes a body having a V-configuration. Thus, the body has longitudinally extending side panels 11 and 12. The plastic material is a commercially available grade that does not crack when it is bent sharply. The side edges of the sheet are bent to form end flanges 13 and 14. The longitudinally extending edges of the sheet are bent to form inwardly extending flanges top 15 and 16. Fasteners such as sheet metal screws or push pins are driven through the end flanges 13 and 14 where they overlap near the apex of the V to maintain the sheet in the exhibited V-shaped cross-section. Opposite ends of the V-shaped sign body receive closure members 18 and 19. Typical closure member 18 has side walls 20 and 21 which are at the same angle relative to each other as are the side walls 11 and 12 of the sign body. The end members 18 and 19 may be formed in one piece. The top of typical end member 18 has holes, such as the one marked 23 for push pins or screws 24 for fastening the end members to the inwardly extending flanges 15 and 16 of the sign body. With the end members attached, the sign body, in conjunction with the end members, forms an adequately rigid structure. The inside face 25 constitutes a closed plastic panel on which is mounted a support element 26 on which there is a downwardly opening notch or slot 27. Support element 26 and notch 27 participate in supporting the sign body as will be explained in detail momentarily.

Figure 1:
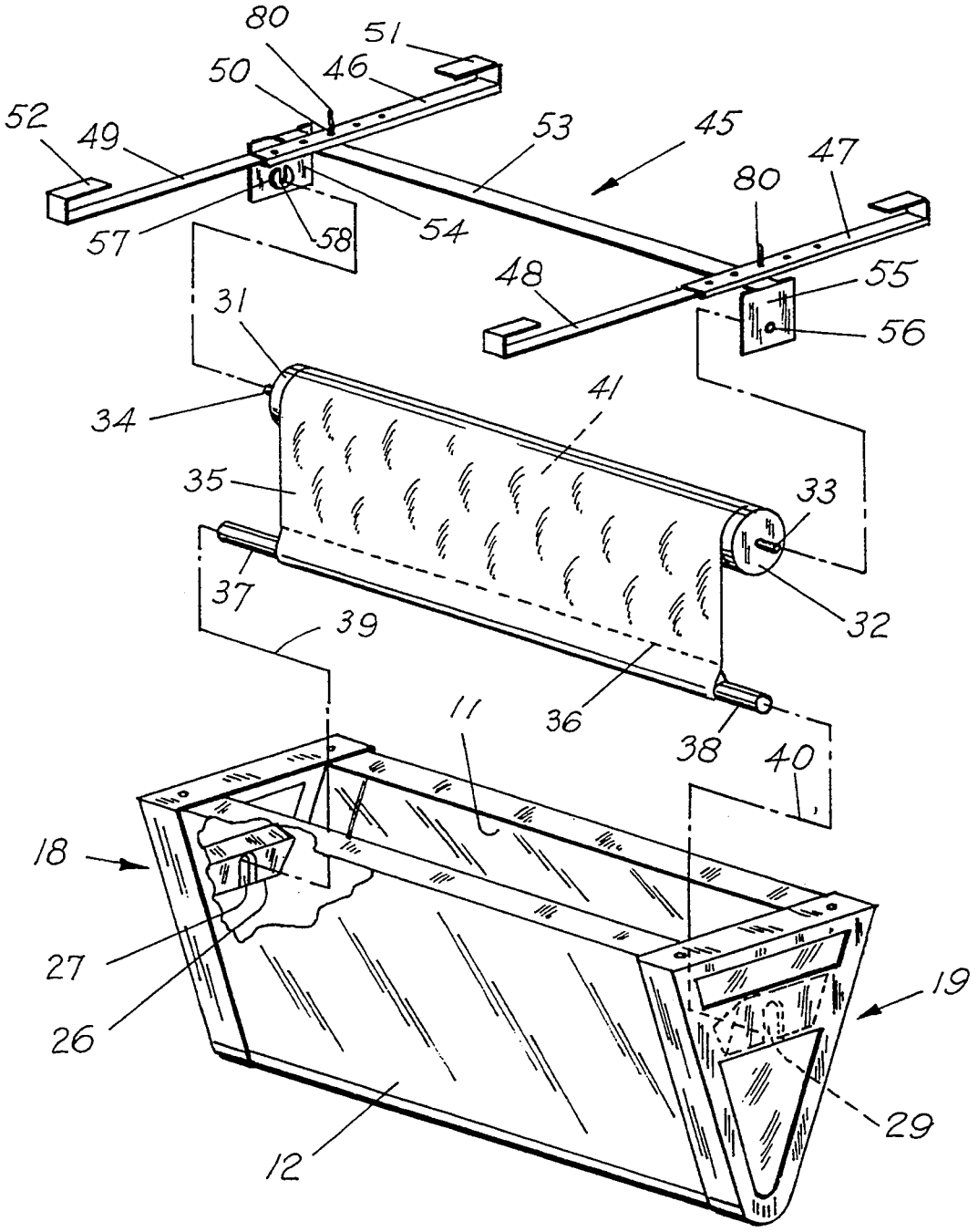
FIG. 1 is an exploded view of the sign and the device for suspending it in proximity to an overhead fluorescent light fixture.

Attention is now invited to FIG. 1 which shows the end closure members 18 and 19 installed on the sign body. One may also see that the end closure members 18 and 19 for the body are provided inside with a downwardly opening notches 27 and 29.

The support device that provides for raising and lowering the sign comprises a tubular spindle mating at opposite ends in circular end caps 31 and 32. A round journal pin 33 extends from end cap 32. A flat or non-circular pin 34 extends from end cap 31. As in the conventional self-winding window shade assembly, the pin 34 is connected internally of the spindle tube in a conventional manner to a spiral spring, not shown, that has one of its ends anchored to the spindle and its other end attached to non-circular pin 34. The torsional force of the spring is applied to the spindle through a ratchet wheel and pawl mechanism, not shown, as in a conventional window shade. A web 35, composed of a material of sufficient width and thickness to provide the strength for supporting the weight of the sign body, has its concealed end fastened securely to the spindle 41. Enough turns of the web are wound on the spindle to allow lowering the sign to a person on the floor of the building. The end of web 25 is looped back on itself and sewn along a line marked 36 to provide a passage for accommodating a laterally extending rod whose ends 37 and 38 project outwardly from the edges of the web by a pre-determined amount. As suggested by the phantom lines 39 and 40, ends 37 and 38 of the rod can be passed through the open top of the sign body so that the ends can register in the inverted notches 28 and 29 which thereby attach the web to the sign body.

In FIG. 1, the hardware for mounting the spindle 41 of the web 35 for supporting the sign body is generally designated by the numeral 45. The hardware comprises channel bar members 46 and 47. A slider bar 49 can slide or telescope relative to channel member 46. The channel bar 48 and slider bar 49 cooperate analogously to the conventional telescoping curtain rod, not shown, which must be adjustable in length. Holes such as the one marked 50 are provided on the channel bar 46 and there are a corresponding series of holes on slider bar 49 to enable pins, not shown, to be inserted through the coincident holes to fix the overall length of the slider bar and channel bar combinations. A typical channel bar 46 and slider bar 49 are respectively provided with end hooks 51 and 52. Channel member 47 and slider bar 48 are similar to slider bar 49 and channel element 46, respectively.

A cross bar 53 is fastened at its opposite ends to the channel bars 46 and 47 of the adjustable length support members 46 and 47. Hanger plates 54 and 55 are mounted to opposite ends of bar 53. Hanger plate 55 has a hole 56 for receiving pin 33 on the web spindle 41. Hanger plate 54 is provided with a boss 57 in which there is a notch 58 that the non-cylindrical pin 34 on one end of the spindle just slides into it snugly and is constrained from rotating. Thus, when the sign body is supported on the web and the web spindle is supported on members 46 and 47, lowering the web and sign thereon causes energy to be stored in the spring, not shown, in the spindle which tends to return the sign to its most elevated position. However, in accordance with traditional design for devices of this type, there is a pawl and ratchet wheel assembly, not shown, within the spindle which latches the web in any position to which it has been pulled downwardly arrived after the manual pulling force is relieved from the web. Hence, the sign on the web will stay at whatever level it is positioned by pulling down on the web with needing to be held in that position so the person working with the sign has both hands free to do such things as clean the sign or exchange the information bearing transparencies which interface with the insides of the side walls 11 and 12 of the sign body.

Figure 3:
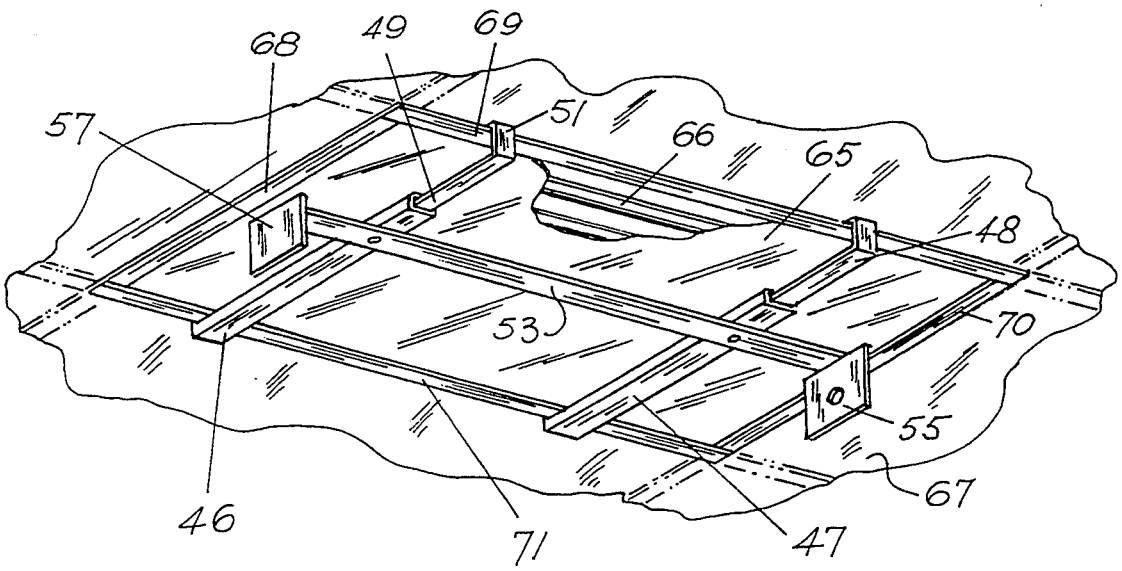
FIG. 3 is a perspective view of the hardware that is used for mounting the sign device in proximity with an overhead fluorescent light fixture, for example.

FIG. 3 shows the sign mounting hardware in position for supporting the web spindle 41 and the sign body although the sign and spindle are removed presently. The lenticular light diffusing panel 65 of a recessed ceiling mounted fluorescent lamp fixture is broken away in FIG. 3 to show the fluorescent tubes 66 behind the panel. Except where there are light fixtures, the ceiling is composed of acoustic panels 67. The ceiling panels 67 are supported on runners or bars 68, 69, 70 and 71 which are shown in FIG. 3 as framing the fluorescent light fixture. Typical hooked ends 51 of the telescoping support elements 46, 49 and 47, 48 are hooked over the flanges of the opposite runners 69 and 71. As previously explained in reference to FIG. 1, the pins 33 and 34 of the web spindle are mounted to the hanger plates 55 and 57. With the sign assembly being supported on the ends 37 and 38 of the rod at the free end of the web, light from the fluorescent tubes can enter the sign assembly through its open top to illuminate the information bearing transparencies so the sign is parasitic in that it works by deriving light from a room lighting fixture and has no light source of its own.

I claim:

1. A sign body and a device for holding the body in an upper position in proximity with a light source mounted overhead and alternatively for holding the body in a lower position to provide access to the sign body, the sign body comprising information displaying light transmitting side panels having opposite corresponding ends and end panels joined respectively with the ends of the side panels, said side panels arranged adjacent each other to provide for a top opening for entry between the panels of light emitted from the source, said device for holding said sign body in said positions comprising a spindle mounted for rotating immediately beneath said light source, a web having lengthwise edges, an end fastened to the spindle and an opposite free end, the web having sufficient length to wind around the spindle a plurality of times, engagement means on said free end of the web and engageable means on each of said end panels for being simultaneously engaged by the engagement means for supporting the sign body from the web, urging said sign body downwardly away from its upper position causing said web to unwind from the spindle for holding the sign body in a lower position and alternatively urging said sign body upwardly away from said lower position causing the web to wind on the spindle for holding the sign body in the upper position to present said top opening to the light source.

2. The combination according to claim 1 wherein said engagement means on the free end of the web comprises a rod member secured to the free end of the web having ends extending laterally in opposite directions from said opposite edges of the web, said engageable means comprises an element on each end panel of the sign body containing a downwardly opening notch for said ends of the rod member to enter the notches, respectively, to support the sign body from the web.

3. The combination according to any one of claims 1 or 2 wherein said light source is comprised of an overhead mounted fixture containing fluorescent tubes.

4. The combination according to any one of claims 1 or 2 including said means for supporting the spindle for rotating comprising lengthwise adjustable elongated members arranged generally in parallel with each other, each such member comprised of a pair of bars adapted for sliding lengthwise relative to each other to provide for extending and contracting the device and means for locking one of the bars in adjusted position relative to the other, a hook element on both bars of the respective elongated devices for supporting the devices proximate to the light source, and a hanger element on one bar of each adjustable device on which said spindle is mounted.

5. The combination according to claim 4 including a cross bar having one end fastened to one of the bars in one of the lengthwise adjustable elongated devices and another end fastened to a corresponding bar in the other of the adjustable elongated devices to prevent said devices from separating from each other.

6. The combination of a box-like sign body and support means for supporting the sign body for being moved between upper and lower positions, the sign body comprising light transmissive side panels arranged adjacent each other to define a top opening for the body, the side panels having opposite ends, laterally spaced apart end panels each spanning between corresponding ends of the side panels and means for fastening the end panels to the side panels to create said boxlike sign body with said open top, the support means comprising a reel including a spindle and a web of predetermined width having one end fastened to the spindle and having an opposite free end, the web having sufficient length to wind around the spindle a plurality of times, means for supporting the spindle for rotating immediately beneath a light source, and rod means fastened to the free end of the web and having end portions extending laterally in opposite directions beyond said width of the web for said portions to connect respectively to said end panels to achieve supporting said sign body from the web, urging said sign body upwardly to its upper position causing said web to wind onto said spindle for supporting said body with its said top opening presented to said light source and urging said body downwardly causing said web to unwind from the spindle to support said sign body in said lower position.

* * * * *